US009932528B2

(12) United States Patent
Sams et al.

(10) Patent No.: US 9,932,528 B2
(45) **Date of Patent: *Apr. 3, 2018**

(54) SYSTEM AND METHOD OF DELIVERING DILUTION WATER DROPLETS WITHIN AN OIL-AND-WATER STREAM

(71) Applicant: Cameron Solutions, Inc., Houston, TX (US)

(72) Inventors: Gary W. Sams, Spring, TX (US); Joseph Min-Hsiun Lee, Houston, TX (US)

(73) Assignee: Cameron Solutions, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/362,263

(22) Filed: Nov. 28, 2016

(65) Prior Publication Data

US 2017/0073590 A1 Mar. 16, 2017

Related U.S. Application Data

(63) Continuation of application No. 14/256,647, filed on Apr. 18, 2014, now Pat. No. 9,505,990.

(51) Int. Cl.

| | |
|---|---|
| ***C10G 31/08*** | (2006.01) |
| ***B01F 5/04*** | (2006.01) |
| ***B01F 5/08*** | (2006.01) |
| ***C10G 21/30*** | (2006.01) |
| ***B01F 3/08*** | (2006.01) |

(52) U.S. Cl.

CPC ..... *C10G 31/08* (2013.01); *B01F 3/0807* (2013.01); *B01F 3/0865* (2013.01); *B01F 5/0456* (2013.01); *B01F 5/0463* (2013.01); *B01F 5/0466* (2013.01); *C10G 21/30* (2013.01); *C10G 2300/4056* (2013.01)

(58) Field of Classification Search

CPC .... B01F 3/0807; B01F 3/0865; B01F 5/0456; B01F 5/0463; B01F 5/0466; C10G 21/30; C10G 2300/4056; C10G 31/08

See application file for complete search history.

(56) References Cited

U.S. PATENT DOCUMENTS 1,838,029 A * 12/1931 Isles ..... B01D 11/0473 196/46

2008/0192566 A1 8/2008 Yamashita

FOREIGN PATENT DOCUMENTS

EP 1586620 A1 10/2005
FR 2286694 A1 4/1976

* cited by examiner

*Primary Examiner* — Renee Robinson
*Assistant Examiner* — Derek Mueller
(74) *Attorney, Agent, or Firm* — Gable Gotwals

(57) ABSTRACT

A system for desalting a crude oil stream includes vessel that has an interior piping structure that releases wash water into a crude oil flow within the vessel. The piping structure, which may have more than one level, has a plurality of spray nozzles for dispersing or releasing the wash water into the flowing crude oil stream. The spray nozzles may be located on a same side or opposite sides of the piping structure. Where multiple levels are used, the number of spray nozzles on each level may be the same as or different than the number of spray nozzles on other levels. The pressure drop through each spray nozzle is no greater than 300 psi and the nozzles deliver a dilution water droplet no larger than 300 microns in diameter. A mixing valve, static mixer, or both can be placed downstream of the vessel.

20 Claims, 7 Drawing Sheets

SYSTEM AND METHOD OF DELIVERING DILUTION WATER DROPLETS WITHIN AN OIL-AND-WATER STREAM

CROSS-REFERENCE TO RELATED APPLICATIONS

The present application is a continuation application which claims priority to U.S. patent application Ser. No. 14/256,647, now U.S. Pat. No. 9,505,990, filed on Apr. 18, 2014, each of which is incorporated herein by reference.

BACKGROUND

The present disclosure relates to apparatuses, systems and methods used in crude oil desalting processes. More particularly, the present disclosure relates to systems and methods used to inject dilution water into a crude oil stream in order to contact and coalesce entrained water within the stream.

The crude oil desalting process involves washing a crude oil stream with water having a low salt content (e.g. typically about 250 ppm or less) followed by electrostatic dehydration of the resulting mixture. The washing step involves mixing the low salt-content ("fresh" or "dilution") water with the crude oil stream so as to add energy into the stream and coalesce the dilution water with the brine water already entrained in the crude oil stream.

Mixing is accomplished through a mixing valve, static mixer, or some combination of the two. The degree of emulsification of the dilution water primarily depends on the pressure drop imparted by the valve. A normal design range for this pressure drop is in a range of 5 to 25 psi, with most valves or mixers operating below 15 psi. If too large of a pressure drop is created, the water droplets decrease to a size which makes them difficult to coalesce and remove in the downstream electrostatic dehydration process. A pressure drop control system, like that shown in FIG. 1, is used to control and operate the drop within the critical range.

Prior to the crude oil stream entering the mixing valve, it is advantageous to disperse the dilution water in the oil phase. This is typically done by way of a disperser which uses medium pressure spraying of the dilution water through holes on the dispersing tube of the disperser at a rate of 3-10% of oil flow rate. The spraying occurs in a direction perpendicular to the flow of the crude oil stream (see FIGS. 2A & B). Use of a static in-line mixer has also proved beneficial in accomplishing this dispersion.

One problem with the prior art dispersion system and method is, the dilution water droplets being sprayed or dispersed into the crude oil stream are greater than 1000 microns in size. In the disclosure described below, spray nozzles atomize wash water into the crude oil stream. The atomized water droplets are in a size range of 10 to 300 microns. This smaller wash water droplet size works to increase the contact efficiency with the brine droplets contained in the crude oil stream, thereby increasing desalting performance.

SUMMARY

In general, disclosed herein are systems, methods, and apparatuses for desalting a crude oil stream includes an elongated, vertically oriented vessel that has an interior, piping structure arranged concentric to the vessel. The piping structure—which can be ring-shaped, cross-bar shaped, or any other shape preferable—has a plurality of spray nozzles oriented at a downward angle and receives wash water from a wash water inlet of the vessel. The piping structure may include more than one level of piping, and each level of piping may be fed by its own wash water inlet.

The spray nozzles may be located on different sides of the piping structure and, when more than one level is used, each level may have a different number of spray nozzles than the other levels. The spacing of the spray nozzles does not have to be even within or between levels and, if located on different sides of the piping structure, the nozzles do not have to be placed opposite one another.

The pressure drop through each spray nozzle is preferably no greater than 300 psi and the nozzles preferably deliver a dilution water droplet preferably no larger than 300 microns in diameter.

This disclosure is to improve desalting performance by increasing the contact efficiency of the wash water with the brine droplets contained in the crude oil stream. Contact efficiency can be further increased by placing a mixing valve, static mixer, or some combination of the two downstream of the vessel.

BRIEF DESCRIPTION OF THE DRAWINGS

So that the manner in which the above recited features can be understood in detail, a more particular description may be had by reference to embodiments, some of which are illustrated in the appended drawings, wherein like reference numerals denote like elements. It is to be noted, however, that the appended drawings, illustrate various embodiments and are therefore not to be considered limiting of its scope, and may admit to other equally effective embodiments.

ELEMENTS AND NUMBERING USED IN THE DRAWINGS AND DETAILED DESCRIPTION

Figure 2B:
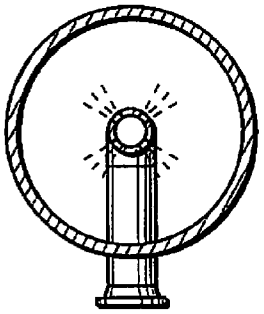
Fig. 2B (PRIOR ART)
FIG. 2B is a view taken along section line 2B of FIG. 2A.
Figure 1:
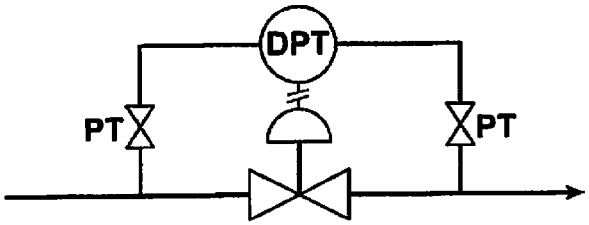
Fig. 1 (PRIOR ART)
FIG. 1 is a schematic of a prior art pressure drop control system.
Figure 2A:
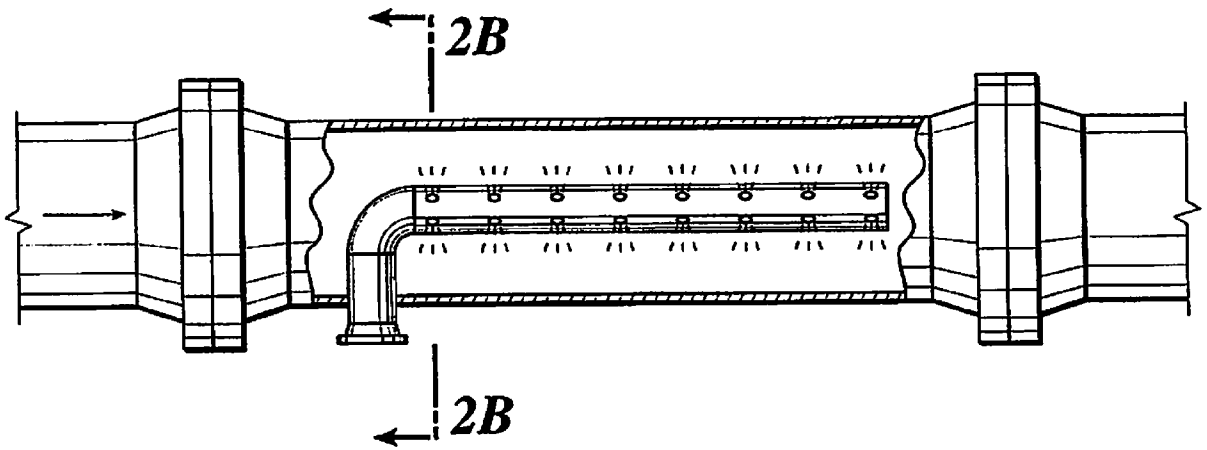
Fig. 2A (PRIOR ART)
FIG. 2A is a cross section view of a prior art mixing injector.

5 Example of a commercial system
10 Mixing vessel
11 Spray nozzle
13 Centerline of 15
15 Spray pattern
17 Longitudinal centerline of 10
19 Inlet pipe
20 Nozzle spool
21 Spray nozzles
23 Wash water inlet
25 Wash water sub-stream

27 Wash water sub-stream
29 Wash water sub-stream
33 Flow meter
35 Wash water sub-inlet
37 Wash water sub-inlet
39 Wash water sub-inlet
45 Vertical pipe connected to 35
47 Vertical pipe connected to 37
49 Vertical pipe connected to 39
55 First or top level connected to 45
57 Second or middle level connected to 47
59 Third or bottom level connected to 49
61 Inner pipe or nozzle ring
63 Outer pipe or nozzle ring
65 Lateral pipe
67 Central longitudinal pipe
71 Spraying head or manifold
81 Crude oil inlet
83 Mixture outlet
85 Flow meter for 25
87 Flow meter for 27
89 Flow meter for 29
91 Flow meter
95 Valve for 25
97 Valve for 27
99 Valve for 29
103 Static mixer
105 Mixing valve
F Flow of oil-and-water stream in 10
P Positive displacement or centrifugal pump
S Interior space of 10

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements", and the term 'set' is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and lower", "upwardly" and "downwardly", "upstream" and "downstream", "above" and "below"; and other like terms indicating relative positions above or below a given point or element are used in this description to more clearly describe some embodiments of the disclosure.

Although the preceding description has been described herein with reference to particular means, materials and embodiments, it is not intended to be limited to the particulars disclosed herein; rather, it extends to all functionally equivalent structures, methods, and uses, such as are within the scope of the appended claims.

Figure 3A:
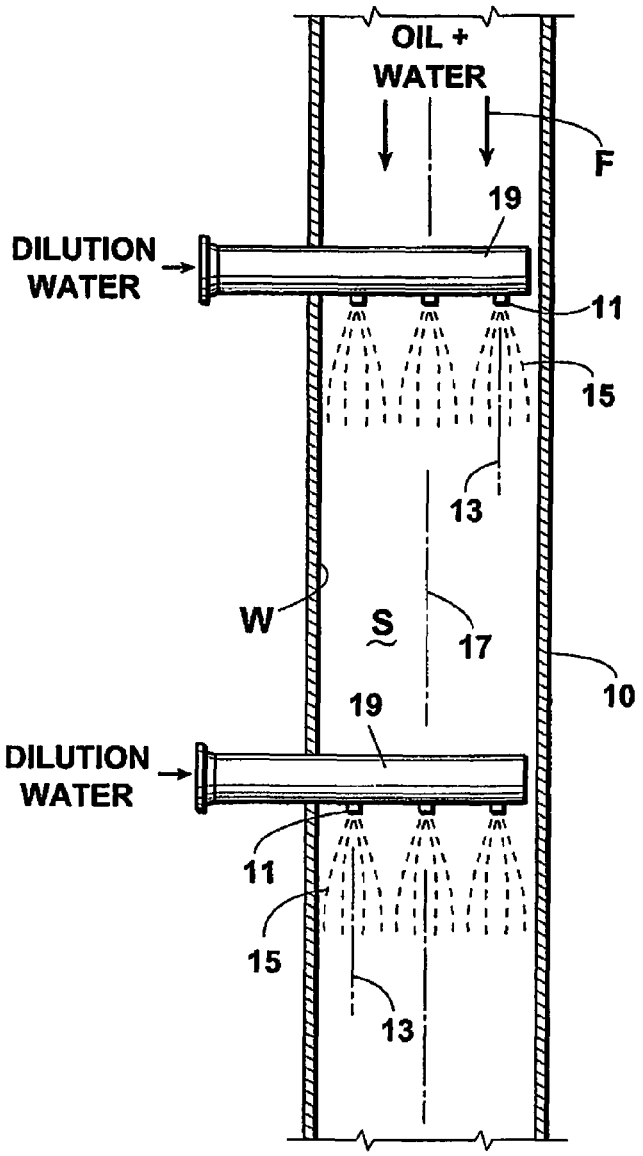
FIG. 3A is a mixing vessel made according to this disclosure.
Figure 3B:
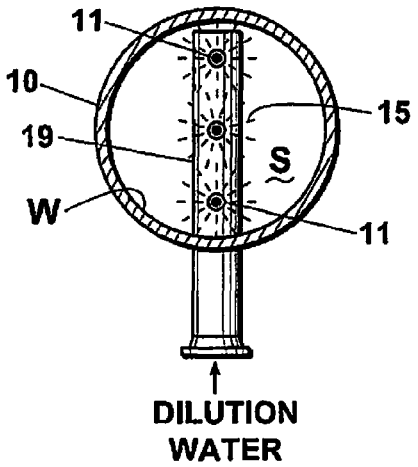
FIG. 3B is a view taken along section line 3B of FIG. 3A.
Figure 5:
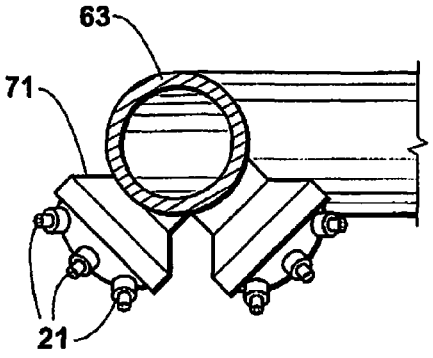
FIG. 5 is a view of the nozzle spool taken along section line 5-5 of FIG. 4.
Figure 4:
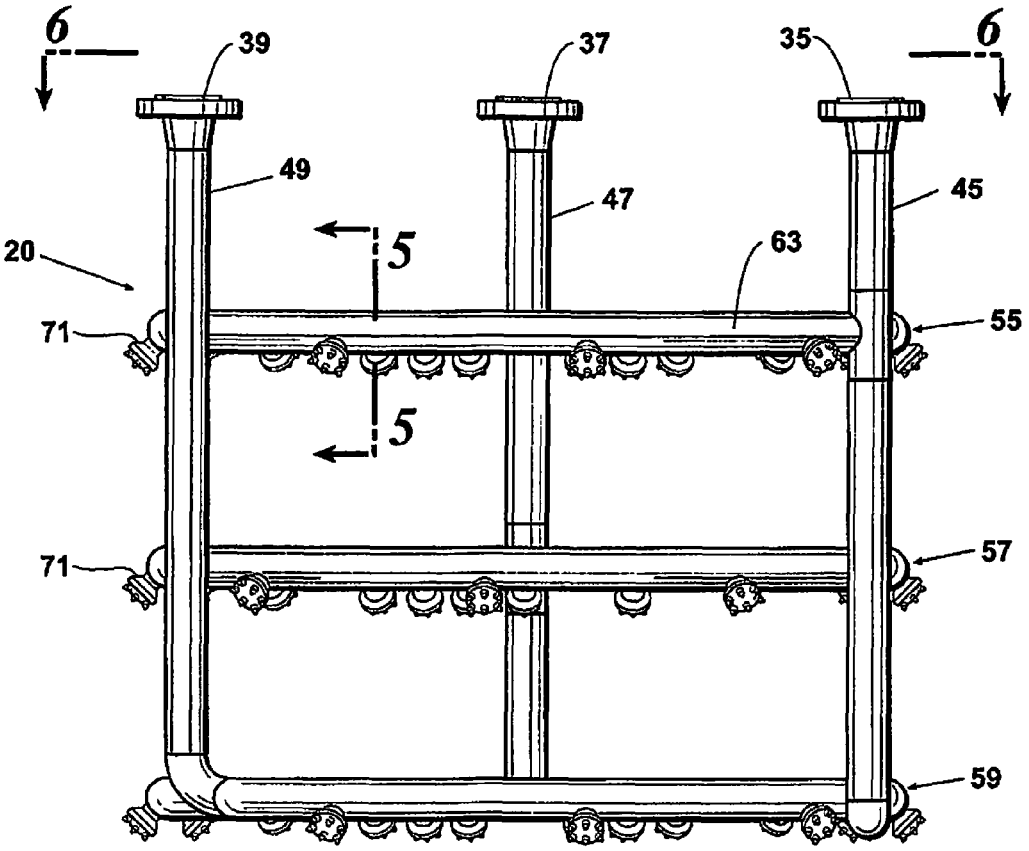
FIG. 4 is a front elevation view of a nozzle spool made according to this disclosure.
Figure 6:
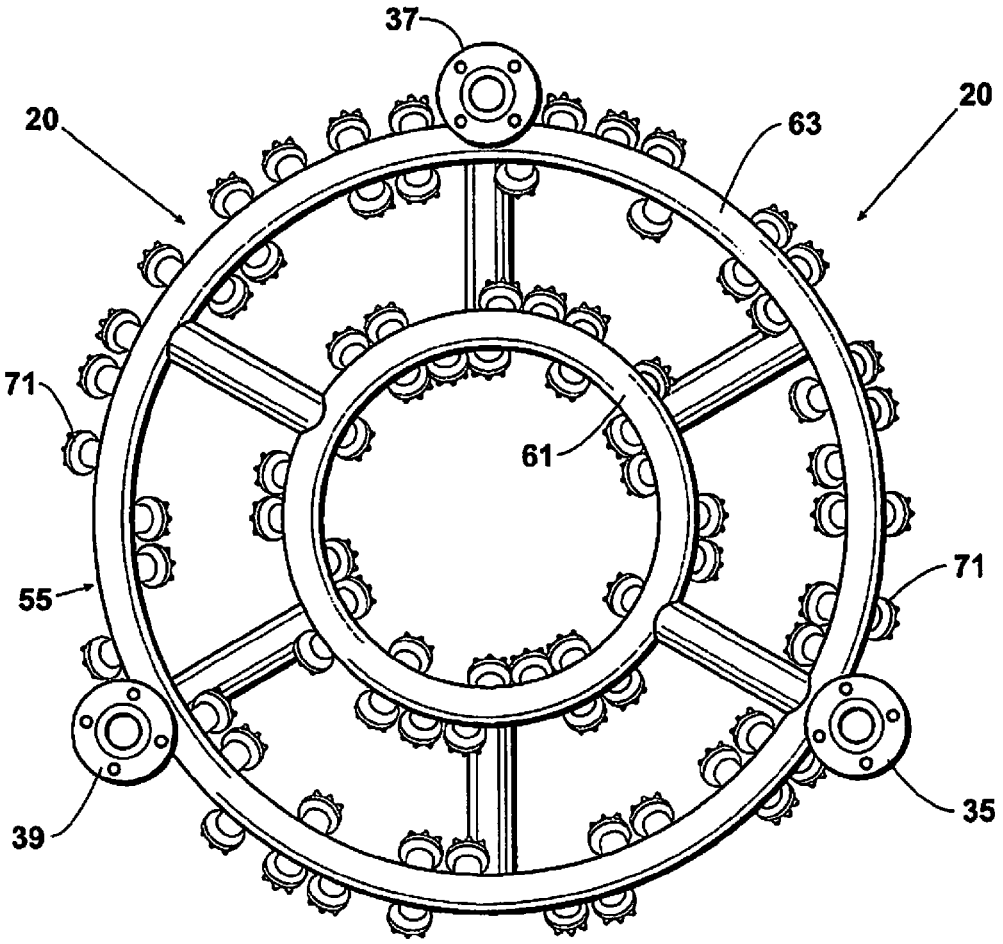
FIG. 6 is a top view of the nozzle spool of FIG. 4.
Figure 7:
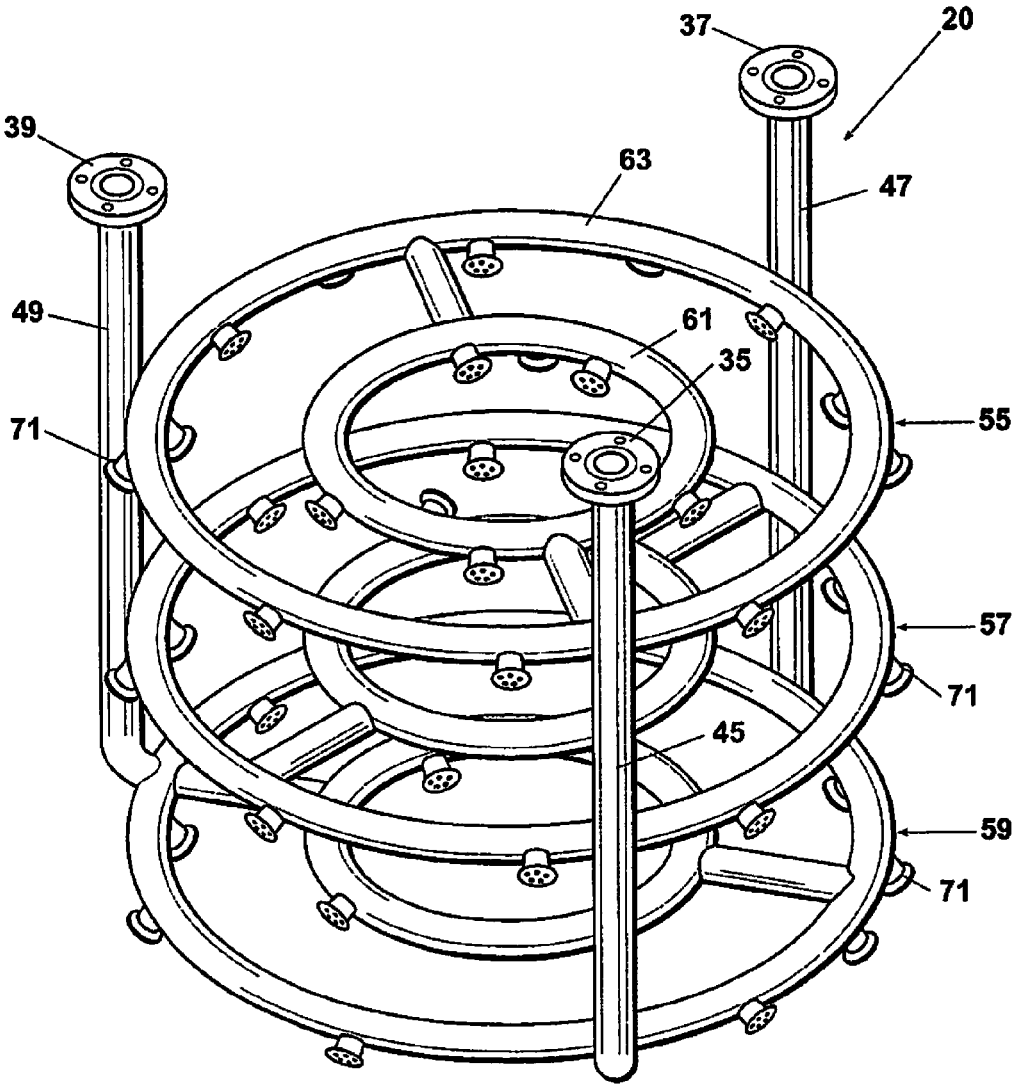
FIG. 7 is an isometric view of the nozzle spool of FIG. 4.

Referring to FIGS. 3A & B, a system and method for delivering dilution water within a crude oil stream includes a mixing vessel 10 with at least one spray nozzle 11 located within an interior space "S" of the vessel 10. The crude oil stream typically is an oil-dominant stream.

The spray nozzle 11 is arranged so that a centerline 13 of a spray pattern 15 of the dilution water droplets being delivered by the spray nozzle 11 is parallel to the longitudinal centerline 17 of the mixing vessel 10 (i.e., in a direction of flow "F" of the crude oil stream flowing through the mixing vessel 10). Therefore, the spray from each nozzle 11 is in a generally downward direction and into the downward flow F of the crude oil stream.

Mixing vessel 10 is a vertically oriented pipe located upstream of a mixing valve (not shown) and electrostatic dehydration process (also not shown). The spray nozzle 11 is plumbed to a horizontally oriented inlet pipe 19 which is in communication with a dilution water source (not shown). The spray nozzles 11 atomize the wash water from the dilution water source into the crude oil.

The spray nozzle 11 can be a first stage (or level) of spraying and at least one other spray nozzle 11 can be arranged downstream from and in an identical manner to the first-mentioned spray nozzle 11. The other spray nozzle 11 is a second stage (or level) of spraying. Multiple stages of spraying within the same mixing vessel 10 can be used as appropriate, as can multiple mixing vessels 10. Each stage within the vessel 10 makes use of the same size of spray nozzle 11 and operates at the same pressures and rates. The number of spray nozzles 11 between inlet pipes 19 may be the same or vary as appropriate.

The pressure drop through each spray nozzle 11 is in a range of 50 psi to 300 psi and in a range of 80 to 120 psi.

The spray nozzles 11 deliver dilution water droplets in the range of 10 to 300 microns in diameter and in the range of 10 to 30 microns in diameter.

The system (FIG. 3A with a single nozzle) was tested in a pilot unit and compared to similar tests run with a conventional disperser like a mix valve and a static mixer. The results show that, for the conventional mix valve and static mixer, the contact efficiency between the wash water droplets and the brine droplets contained in the crude oil stream is in the range of 40 to 50%. The contact efficiency for the system and method described above is in the range of 60 to 70%.

If the spray nozzle 11 is located upstream of a conventional disperser like a mix valve, the contact efficiency increases to 90%. Therefore, the spray nozzle 11 can be used along with a conventional mix valve, static mixer, or both to improve contact efficiency (see e.g. FIG. 8 for an example commercial installation 5).

Figure 9:
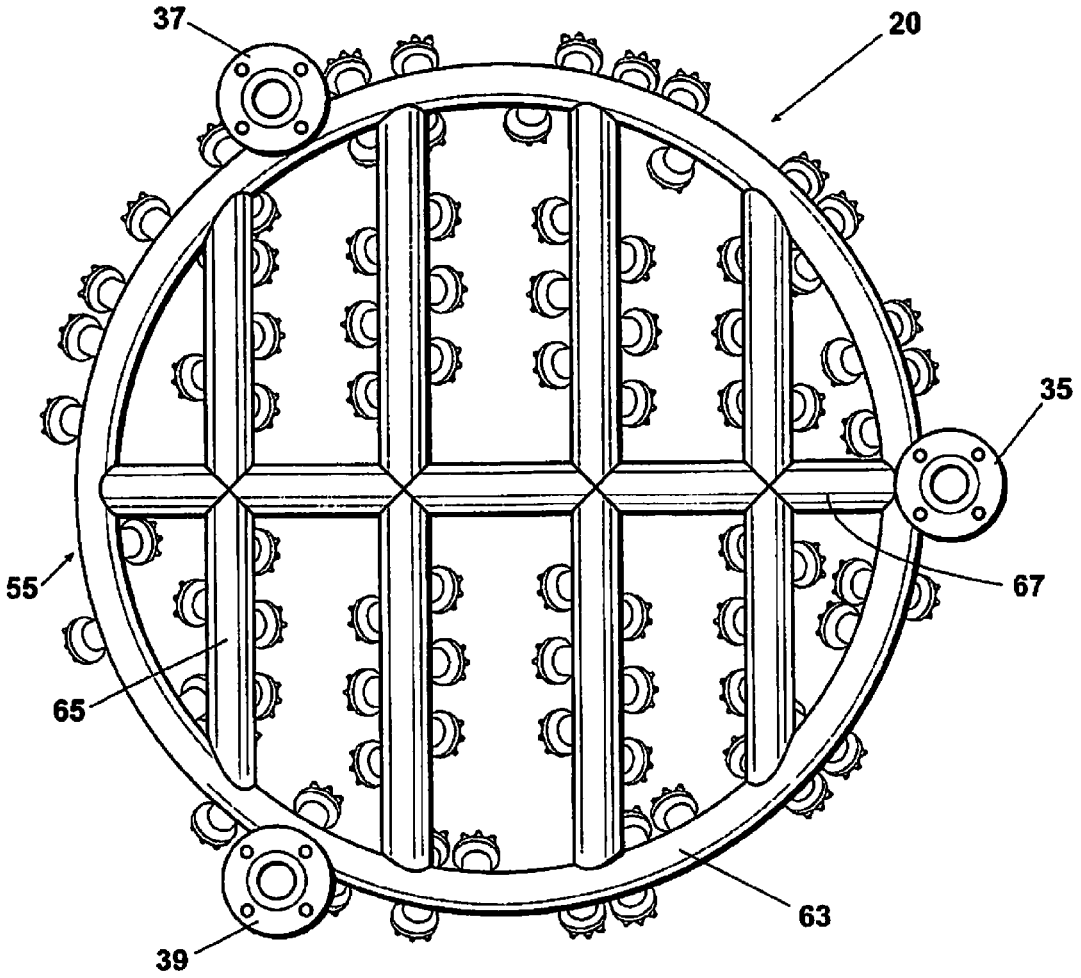
FIG. 9 is top view of an embodiment of the nozzle spool. The ring-shaped levels are replaced by a cross-bar shaped level.

Referring now to FIGS. 4-7, an alternate embodiment of mixing vessel 10 includes a multi-level "nozzle spool" 20 having concentric inner and outer circular pipes or rings 61, 63 on each level 55, 57, 59 of the spool 20. Other piping arrangements can include other shapes, such as but not limited to a cross-bar shaped arrangement like that shown in FIG. 9 in which lateral pipes 65 extend from a central longitudinal pipe 67 connected to a ring 63 and its respective wash water inlet 35, 37, or 39 (e.g., inlet 35 for first level 55). The spool 20 may also be a single level spool.

Each level 55, 57, 59 is connected to three vertical pipes 45, 47, and 49, with one vertical pipe 45, 47 or 49 providing wash water to the level 55, 57, 59 and that level's rings 61, 63. Each ring 61, 63 supports a plurality of spraying heads or manifolds 71, each manifold 71 having a plurality of spray nozzles 21. The first or top level 55 has 45% of the total spray nozzles 21, the second or middle level 57 has 30% of the total nozzles 21, and the third or bottom level 59 has 25% of the total nozzles 21.

Figure 8:
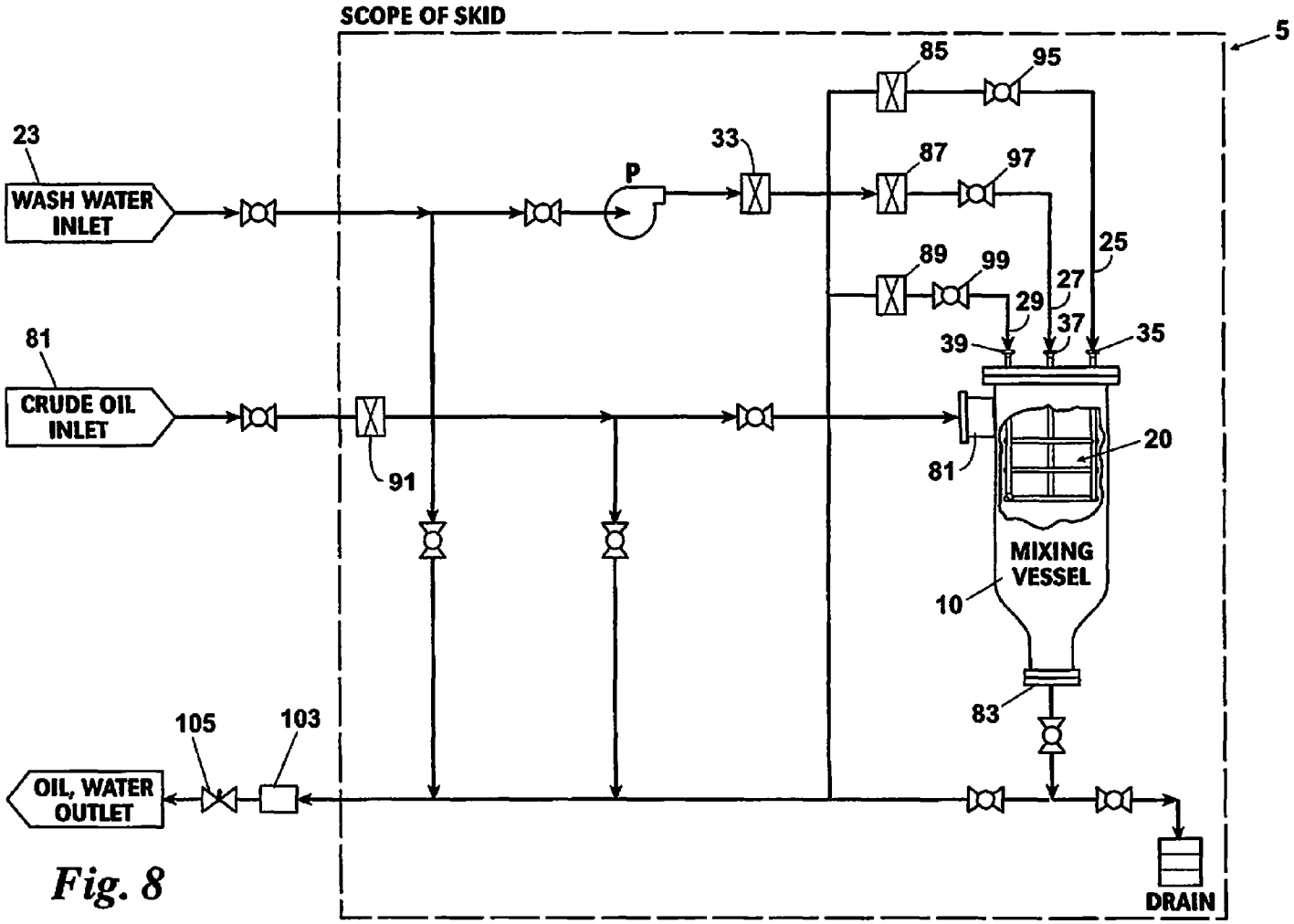
FIG. 8 is a schematic of a system and method which makes use of a mixing vessel that houses the nozzle spool of FIG. 4.

Referring now to FIG. 8, the mixing vessel 10 has five ports: a crude oil inlet 81, three wash water inlets, 35, 37, 39, and a mixture outlet 83. Note that vessel 10 may have an internal pipe structure or arrangement other than that of nozzle spool 20 as shown in FIGS. 4-9. A positive displacement or centrifugal pump P pumps the wash water stream to the vessel 10 and guarantees the working pressure for the spray nozzles 21. A flow meter 33 monitors the wash water stream.

Before entering the vessel 10, the wash water stream is divided into three sub-streams 25, 27, and 29 to allow a reasonable system turndown ratio. The sub-streams 25, 27 and 29 provide a wash water sub-stream to a respective vertical piping 45, 47 or 49 connected to the top, middle, or bottom level 55, 57, 59 (and the level's respective rings 61,63) of the nozzle spool 20.

Each inlet stream or piping 25, 27, 29 is equipped with a respective flow meter 85, 87, 89 and an on-off valve 95, 97, 99. The flow meter 85, 87, 89 monitors the sub-stream line 35, 37, 39 for plugged or leaking spray nozzles 21. The on-off valve 95, 97, 99 is used to direct the flow to each ring 61, 63 on the respective level 55, 57, 59 to maintain the pressure drop through the nozzles 21.

Similar to spray nozzle 11, spray nozzles 21 atomize the wash water from the dilution water source into the crude oil stream. The pressure drop through each spray nozzle 21 is in a range of 50 psi to 300 psi, and in a range of 80 to 120 psi. The spray nozzles 21 deliver dilution water droplets in the range of 10 to 300 microns in diameter and in the range of 10 to 30 microns in diameter. The spray from each nozzle 21 is in a general downward direction and into the crude oil flow as it flows in a downward direction through the vessel 10.

A crude oil stream enters the system through a crude oil inlet 81. The crude oil flow rate is monitored by a flow meter 91. The mixing vessel 10 could be bypassed to route the crude oil flow to static mixer 103 and mixing valve 105.

Vessel 10, when in use, represents the washing step located upstream of a separator vessel such as an electrostatic dehydration unit. The vessel 10 may replace the typical washing step described in the Background section or may be used in combination with it (see e.g., FIG. 8). One or more vessel 10's may be used prior to the mixed oil-and-water stream being routed to downstream equipment such as dehydrator or desalter vessel.

The system and method described above are not all of the possible embodiments of the disclosure. The scope of the disclosure is defined by the following claims, including elements or steps which are equivalent to those recited.

What is claimed:

1. A system for use in a crude oil desalting operation, the system comprising an elongated vessel including a crude oil inlet located toward a top end of the vessel, an oil-and-water outlet, and at least one wash water inlet, the system comprising:

a piping arrangement located within an interior space of the vessel and including a plurality of spray nozzles arranged to receive wash water from the at least one wash water inlet and release the wash water into a crude oil flow flowing within the vessel.

2. A system according to claim 1 wherein the piping arrangement includes two or more levels of piping.

3. A system according to claim 2 wherein one level of the piping arrangement is connected to the at least one wash water inlet and another level is connected to a different wash water inlet of the vessel.

4. A system according to claim 2 wherein the number of spray nozzles in the plurality of spray nozzles differs between the two or more levels of piping.

5. A system according to claim 1 wherein each spray nozzle in the plurality of spray nozzles delivers a dilution water droplet in a range of 10 to 300 microns in diameter.

6. A system according to claim 1 wherein a pressure drop through each spray nozzle in the plurality of spray nozzles is in a range of 50 to 300 psi.

7. A system according to claim 1 further comprising at least one of a mixing valve and a static mixer located downstream of the vessel.

8. A system according to claim 1 further comprising at least a portion of the plurality of spray nozzles being angled toward a bottom end of the vessel.

9. A system according to claim 1 further comprising at least a portion of the plurality of spray nozzles being angled toward a sidewall of the vessel.

10. A system according to claim 1 further comprising the oil-and-water outlet being located toward a bottom end of the vessel.

11. A system according to claim 1 further comprising the piping arrangement is arranged concentric to a longitudinal axis of the vessel.

12. A system according to claim 1 further comprising the vessel being vertically oriented.

13. A method of desalting a crude oil stream, the method comprising the steps of:

routing a crude oil stream into an elongated vessel, the vessel including an oil inlet located toward a top end of the vessel, an oil-and-water outlet, and at least one wash water inlet;

routing a wash water stream into a piping arrangement located within an interior space of the vessel and including a plurality of spray nozzles arranged to receive wash water from the at least one wash water inlet; and releasing the wash water stream through the plurality of spray nozzles and into the crude oil stream.

14. A method according to claim 13 wherein the piping arrangement includes two or more levels of piping.

15. A method according to claim 14 wherein one level of the piping arrangement is connected to the at least one wash water inlet and another level is connected to a different wash water inlet of the vessel.

16. A method according to claim 14 wherein the number of spray nozzles in the plurality of spray nozzles differs between the two or more levels of piping.

17. A method according to claim 13 wherein each spray nozzle in the plurality of spray nozzles delivers a dilution water droplet in a range of 10 to 300 microns in diameter.

18. A method according to claim 13 wherein a pressure drop through each spray nozzle in the plurality of spray nozzles is in a range of 50 to 300 psi.

19. A method according to claim 13 further comprising at least one of a mixing valve and a static mixer located downstream of the vessel.

20. A vessel for desalting a crude oil stream, the vessel comprising:

a multi-level piping structure located within an interior space of the vessel, each level of the piping structure including a plurality of spray nozzles arranged to receive wash water from a wash water inlet connected to the level and release the wash water into a crude oil stream flowing within the vessel.

* * * * *